US005524773A

United States Patent [19]

Molinoli

[11] Patent Number: 5,524,773

[45] Date of Patent: Jun. 11, 1996

[54] APPARATUS FOR ORGANIZING A WORK AREA AND FOR LOCATING PROPERLY SIZED NAILS, SCREWS AND THE LIKE

[76] Inventor: Bruce A. Molinoli, 78 W. Sutter Rd., Paradise, Calif. 95969

[21] Appl. No.: 305,048

[22] Filed: Sep. 13, 1994

[51] Int. Cl.[6] ..... A47F 7/00

[52] U.S. Cl. ..... 211/13; 40/617

[58] Field of Search ..... 211/13, 70.6; 40/617, 40/594, 657, 312, 325; 206/372, 373; 24/306, 442

[56] References Cited

U.S. PATENT DOCUMENTS

| | | | |
|---|---|---|---|
| 1,422,529 | 7/1922 | Bingaman | 40/312 |
| 1,478,511 | 12/1923 | Fetters | 40/617 |
| 1,810,826 | 6/1931 | Gray | 211/13 |
| 3,782,558 | 1/1974 | Schael, Jr. | 211/13 |
| 4,206,869 | 6/1980 | Gurevitz | 40/312 |
| 4,756,409 | 7/1988 | Murray | 40/312 |
| 4,951,826 | 8/1990 | Tompkins | 248/205.2 |
| 5,228,571 | 7/1993 | Anderson | 211/13 |
| 5,234,113 | 8/1993 | Ramey | 211/13 |

*Primary Examiner*—Leslie A. Braun

*Assistant Examiner*—Willie Berry, Jr.

[57] ABSTRACT

An apparatus for organizing a work area and for locating properly sized nails, screws and other fasteners is comprised of a vertically disposed plate with upper and lower edges and side edges. The plate has a rear surface and a front surface that are adapted to have indicia and objects. A plurality of vertically disposed description zones are along one edge of the front surface, and a plurality of vertically disposed locator zones are along the other edge of the front surface. A plurality of vertically disposed locator zones are along the other edge of the front surface. Each description zone is laterally offset from a related locator zone, with each description zone having distinctive indicia. Each of the locator zones has distinctive indicia with the description indicia and locator indicia in related pairs, laterally offset from each other. A vertically disposed support region is located between the description zones and the locator zones. The support region includes a first strip of a pile type fastener that is secured with respect to the central vertical extent of the plate. A removable pile type fastener strip is removably coupled to the fixed pile type fastener strip whereby objects representative of each laterally disposed pair of indicator and locator zones may be received and supported.

2 Claims, 4 Drawing Sheets

FIG. 4
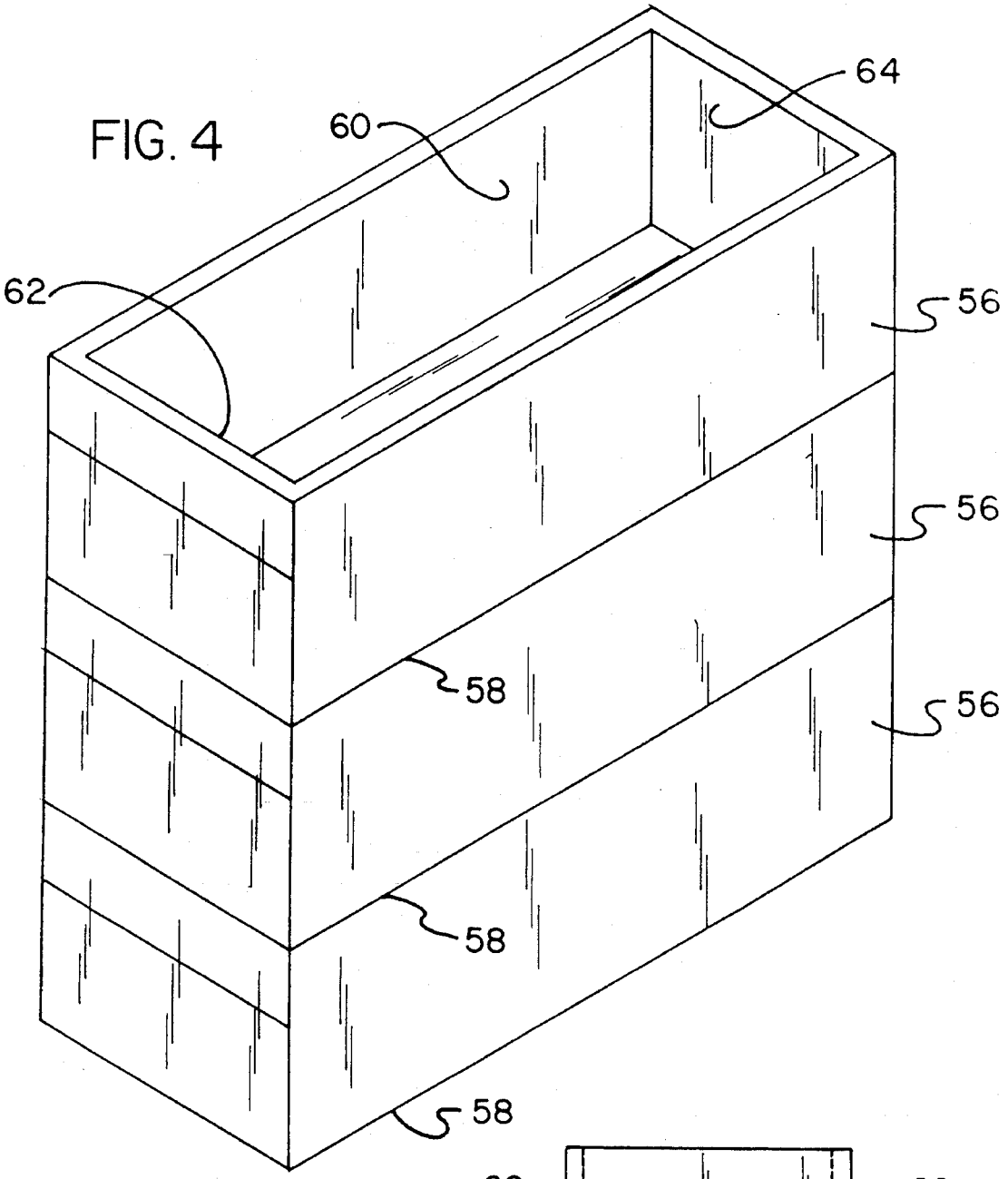
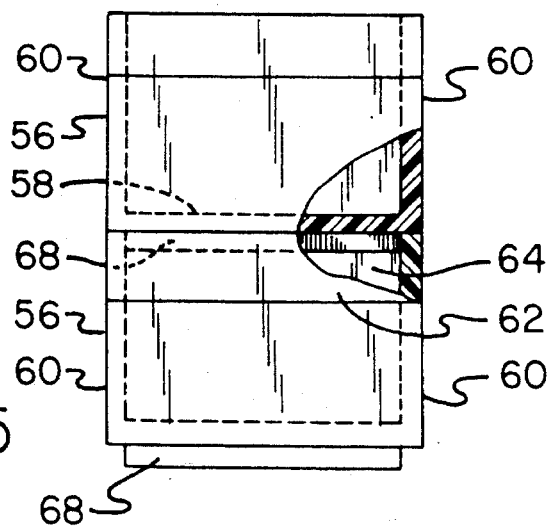
FIG. 5

APPARATUS FOR ORGANIZING A WORK AREA AND FOR LOCATING PROPERLY SIZED NAILS, SCREWS AND THE LIKE

BACKGROUND OF THE INVENTION

1. Field of the Invention

The present invention relates to an apparatus for organizing a work area and for locating properly sized nails, screws and the like and more particularly pertains to locating nails or screws or other hardware of a particular size through a locator system which includes a support for the various items to assist in locating them.

2. Description of the Prior Art

The use of organizing systems for a wide variety of objects including hardware is known in the prior art. More specifically, organizing systems for a wide variety of objects including hardware heretofore devised and utilized for the purpose of locating items which are stored through a wide variety of techniques, systems and apparatus are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 253,926 to Jervis discloses a combined nail storage and display rack.

U.S. Pat. No. Des. 296,398 to Cugley discloses a display bin.

U.S. Pat. No. 4,476,985 to Norberg discloses a screw and bolt tray displayer.

U.S. Pat. No. 5,076,612 to Nirmel discloses a system and method for accurately locating objects of assorted shapes and sizes on a substantially vertical supporting surface.

Lastly, U.S. Pat. No. 5,090,577 to Lehmann discloses a merchandising display unit with improved divider.

In this respect, the apparatus for organizing a work area and for locating properly sized nails, screws and the like according to the present invention substantially departs from the conventional concepts and designs of the prior art, and in doing so provides an apparatus primarily developed for the purpose of locating nails or screws or other hardware of a particular size through a locator system which includes a support for the various items to assist in locating them.

Therefore, it can be appreciated that there exists a continuing need for a new and improved apparatus for organizing a work area and for locating properly sized nails, screws and the like which can be used for locating nails or screws or other hardware of a particular size through a locator system which includes a support for the various items to assist in locating them. In this regard, the present invention substantially fulfills this need.

SUMMARY OF THE INVENTION

In view of the foregoing disadvantages inherent in the known types of organizing systems for a wide variety of objects including hardware now present in the prior art, the present invention provides an improved apparatus for organizing a work area and for locating properly sized nails, screws and the like. As such, the general purpose of the present invention, which will be described subsequently in greater detail, is to provide a new and improved apparatus for organizing a work area and for locating properly sized nails, screws and the like and method which has all the advantages of the prior art and none of the disadvantages.

To attain this, the present invention essentially comprises a new and improved apparatus for organizing a work area and for locating properly sized nails, screws and the like comprising, in combination, a vertically disposed plate having parallel upper and lower edges and have downwardly tapering side edges, the plate having a rear surface adapted to be received against a recipient member and a front surface adapted to have indicia and objects thereon; a plurality of vertically disposed description zones along one edge of the front surface and a plurality of vertically disposed locator zones along the other edge of the front surface, each description zone being laterally offset from a related locator zone with each description zone having distinctive indicia and each of the locator zones having distinctive indicia with the description indicia and locator indicia being in related pairs laterally offset from each other; a vertically disposed support region located between the description zones and the locator zones, the support region including a first strip of pile type fastener secured with respect to the central vertical extent of the plate and a removable pile type fastener strip removably coupled to the fixed pile type fastener strip whereby objects representative of each laterally disposed pair of indicator and locator zones may be received and supported thereat; a tie-cord having free ends secured to the upper edge of the plate with a central extent adapted to be supported on a fastener in the recipient member; and a plurality of containers in a box like configuration with a bottom wall located in a horizontal plane and upstanding side, front and rear vertical walls secured to each other and the bottom wall for the receipt of objects, the containers having a downwardly extending box-like projection positionable within the upper edge of an adjacent container and with indicia on the front wall exposed for view to indicate the nature of the contents within the container and correlated to a particular indicia at a locator zone.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved apparatus for organizing a work area and for locating properly sized nails, screws and the like which has all the advantages of the prior art organizing systems for a wide variety of objects including hardware and none of the disadvantages.

It is another object of the present invention to provide a new and improved apparatus for organizing a work area and for locating properly sized nails, screws and the like which may be easily and efficiently manufactured and marketed.

It is further object of the present invention to provide a new and improved apparatus for organizing a work area and for locating properly sized nails, screws and the like which is of durable and reliable constructions.

An even further object of the present invention is to provide a new and improved apparatus for organizing a work area and for locating properly sized nails, screws and the like which is susceptible of a low cost of manufacture with regard to both materials and labor, and which accordingly is then susceptible of low prices of sale to the consuming public, thereby making such apparatus for organizing a work area and for locating properly sized nails, screws and the like economically available to the buying public.

Still yet another object of the present invention is to provide a new and improved apparatus for organizing a work area and for locating properly sized nails, screws and the like which provides in the apparatuses and methods of the prior art some of the advantages thereof, while simultaneously overcoming some of the disadvantages normally associated therewith.

Even still another object of the present invention is to locate nails or screws or other hardware of a particular size through a locator system which includes a support for the various items to assist in locating and to always have at least one ready for future use.

Lastly, it is an object of the present invention to provide a new and improved apparatus for organizing a work area and for locating properly sized nails, screws and the like comprising a vertically disposed plate having parallel upper and lower edges and have side edges, the plate having a rear surface and a front surface adapted to have indicia and objects thereon; a plurality of vertically disposed description zones along one edge of the front surface and a plurality of vertically disposed locator zones along the other edge of the front surface, each description zone being laterally offset from a related locator zone with each description zone having distinctive indicia and each of the locator zones having distinctive indicia with the description indicia and locator indicia being in related pairs laterally offset from each other; and a vertically disposed support region located between the description zones and the locator zones, the support region including a first strip of pile type fastener secured with respect to the central vertical extent of the plate and a removable pile type fastener strip removably coupled to the fixed pile type fastener strip whereby objects representative of each laterally disposed pair of indicator and locator zones may be received and supported.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of a plurality of containers nested one above the other.

FIG. 5 is a front elevational view of the containers of FIG. 4 with parts broken away to show certain internal constructions thereof.

The same reference numerals refer to the same parts through the various Figures.

DESCRIPTION OF THE PREFERRED EMBODIMENT

Figure 1:
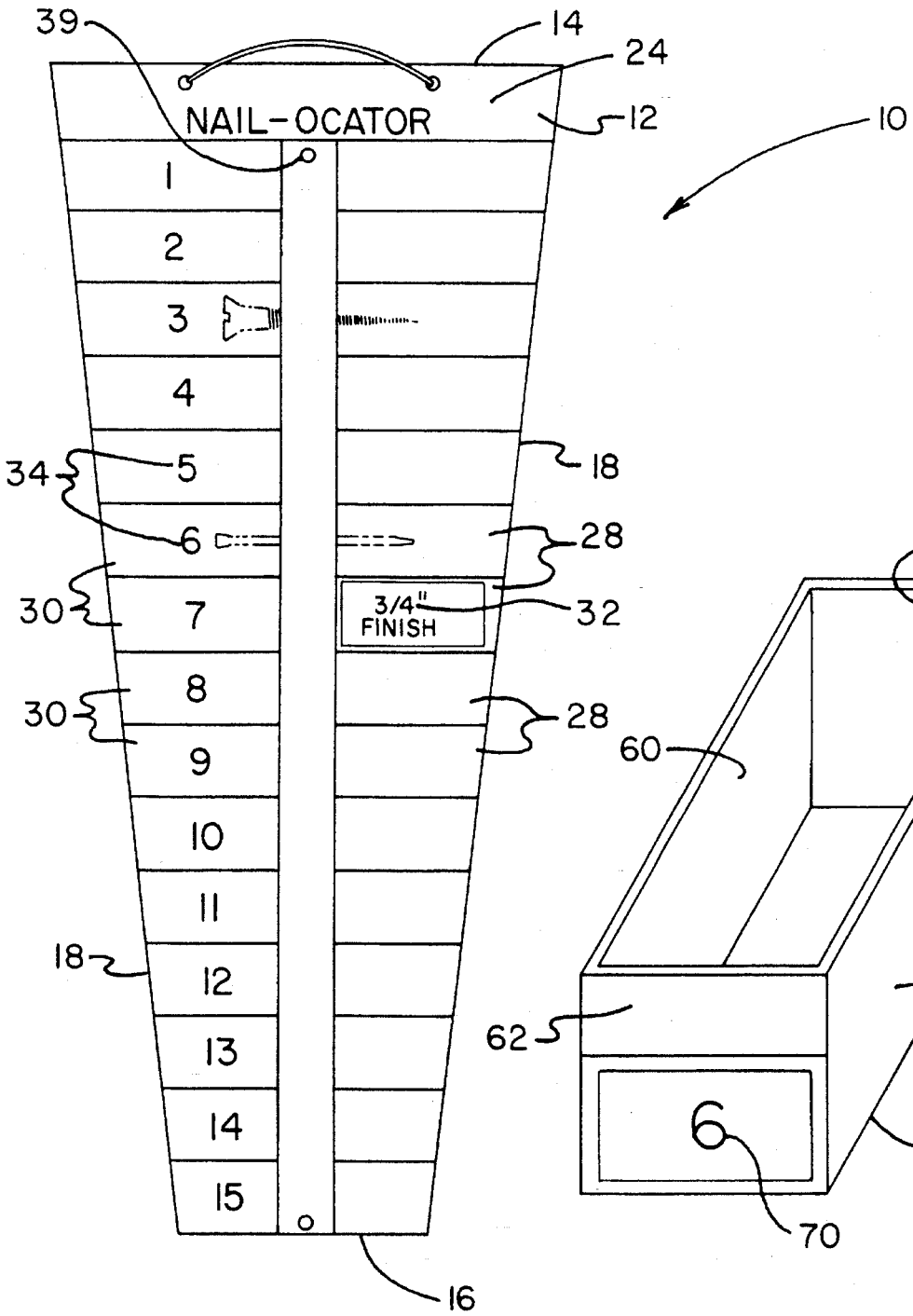
FIG. 1 is a perspective view of the preferred embodiment of the apparatus for organizing a work area and for locating properly sized nails, screws and the like constructed in accordance with the principles of the present invention.
Figure 2:
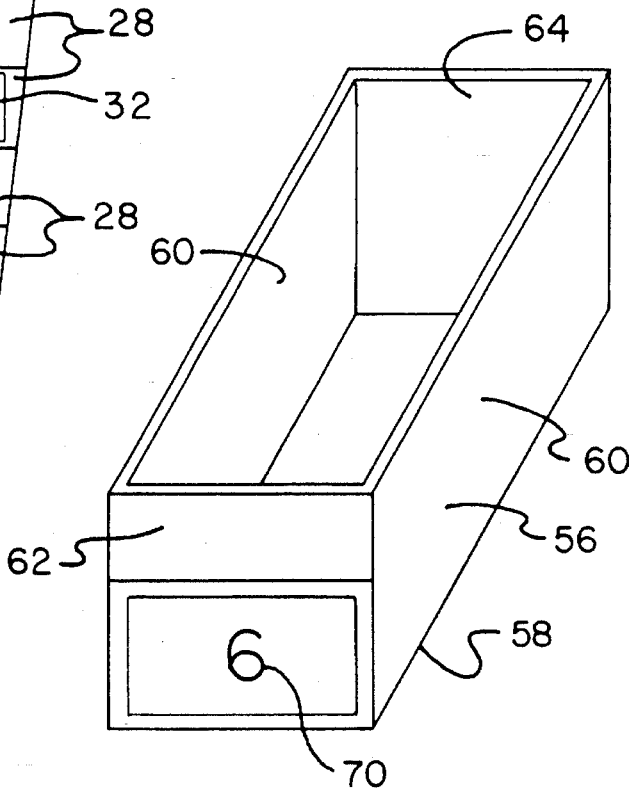
FIG. 2 is a perspective illustration of one of the containers used in association with the plate of FIG. 1.
Figure 3:
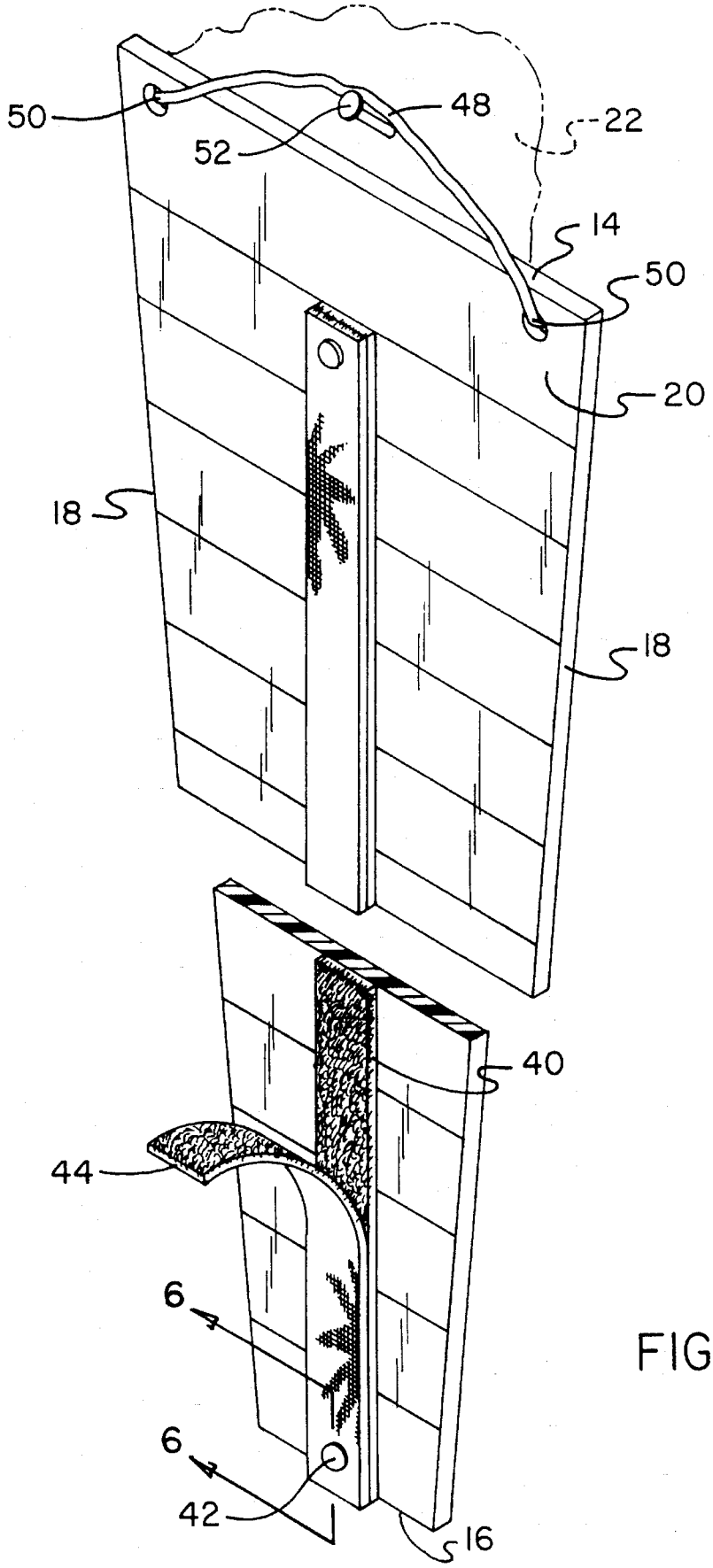
FIG. 3 is a perspective showing of the plate of FIG. 1 but viewed from the opposite side thereof.
Figure 6:
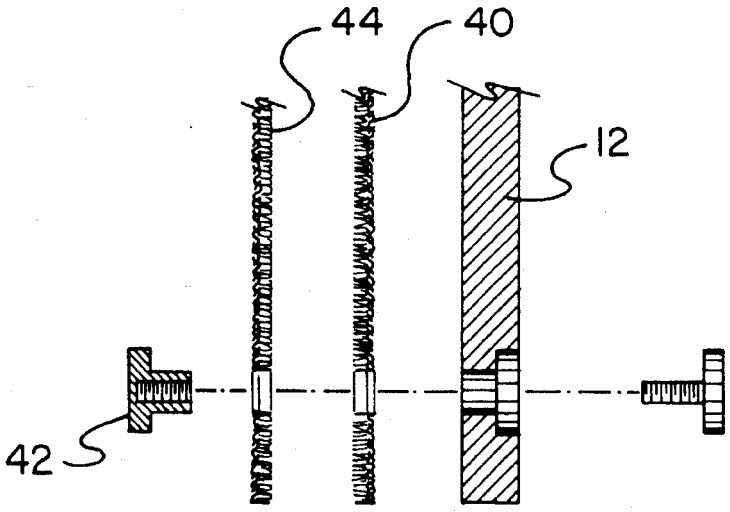
FIG. 6 is an exploded perspective view of the coupling of the plate taken through one of the ends of the pile-type fasteners.
Figure 7:
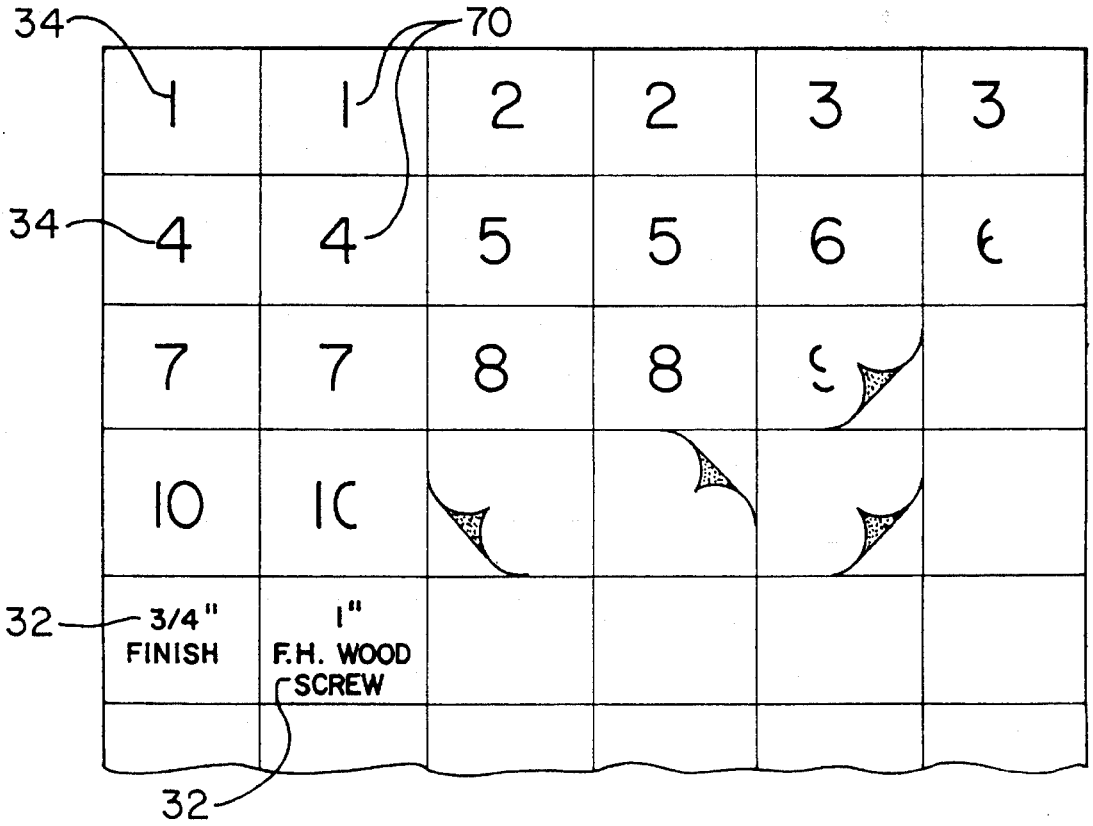
FIG. 7 is a front elevational view of a plurality of adhesive marking tabs with indicia for use in association with the plate and containers of FIGS. 1 and 2.

With reference now to the drawings, and in particular to FIG. 1 thereof, the preferred embodiment of the new and improved apparatus for organizing a work area and for locating properly sized nails, screws and the like embodying the principles and concepts of the present invention and generally designated by the reference numeral 10 will be described.

The present invention, the new and improved apparatus for organizing a work area and for locating properly sized nails, screws and the like is comprised of a plurality of components. Such components in their broadest context include a support plate, description zones and locator zones, a support region, a tie-cord and related containers. Such components are individually configured and correlated with respect to each other so as to attain the desired objective.

The central component of the system 10 is a vertically disposed plate 12. The plate has parallel upper and lower edges 14 and 16. It has also downwardly tapering side edges 18. The side edges taper downwardly in a symmetrical configuration. The plate also has a rear surface 20. Such rear surface is adapted to be received against a recipient member 22 such as a wall. The plate also has a front surface 24 adapted to have indicia and objects thereon.

The front surface of the plate includes a plurality of vertically disposed description zones 28. The description zones are located along one edge of the front surface. Also located on the front surface are a plurality of vertically disposed locator zones 30. Such locator zones are located along the other edge of the front surface. Each description zone is situated laterally offset from a related locator zone. Each description zone has distinctive indicia 32 and each of the locator zones has distinctive indica 34. The description indicia and locator indicia are positioned in related pairs laterally offset from each other with a space therebetween.

The plate also includes a vertically disposed support region 38. Such support region is located between the description zones and the locator zones. The support region includes a first strip of a pile type fastener 40. Such strip is secured as through rivets 42 with respect to the central vertical extent of the plate. In association with the first strip of the pile type fastener is a second strip 44. The second strip is also of a pile type fastener and it is removably coupled to the first or fixed pile type fastener strip. In this manner, object representative of each laterally disposed pair of locator and indicator zones may be received and supported thereat.

In the preferred embodiment, the plate is secured on a recipient surface such as a wall through a tie-cord 48. The tie-cord has free ends 50 secured as through holes to the upper edge of the plate. A central extent of the tie-cord is adapted to be supported on a fastener 52 extending outwardly from the recipient member wall.

The last component of the system 10 is a plurality of containers 56. Each container is in a box-like configuration. Each container has a bottom wall 58 positionable in a horizontal plane. Each container also contains upstanding side, front and rear vertical walls 60, 62 and 64. Such vertical walls are secured at their edges to each other and at their lower extent to the edges of the bottom wall. As such, the containers are capable of receiving objects.

The containers also have downwardly extending box-like projections 68. Such projections are positionable within the upper peripheral edge of an adjacent container therebeneath. In addition, indicia 70 is provided on the front wall of each container in a location to be exposed for view to indicate the nature of the contents within the container which is correlated to a particular indicia at the locator zone.

The present invention is a simple and inexpensive device used to determine the exact location of any nail, fastener or other items which may be needed when work is performed. Most home mechanics and do-it-yourselfers keep such items in containers to prevent them from being mixed together. This would require sorting every time a fastener is needed. It is not the ideal way to keep track of such items because either the containers are not labeled or are not arranged in an organized manner. A well-arranged work area should enable anyone to simply reach into a compartment which holds exactly what they need, regardless of how many items are available.

The present invention is an index which shows everything on hand and exactly where each item can be located. It is made of thin sheet metal and can be hung on a wall near a bin that contains individual compartments, or coffee cans, etc., for nails, screws and the like. The index has two columns, one of which shows the numbers that have been assigned to each compartment. Directly across from the number is a description of what is in the compartment. For quick reference, a sample of the item can be shown, held in place by a hook and loop strip which is positioned vertically between the two columns.

It would be well to have several such indexes, along with individual bins. One set could be for nails, another for machine screws, one for nuts, and so on. Preprinted labels describing the items would simplify the marking and listing process and would arrange the hardware in a much more organized manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An apparatus for organizing a work area and for locating properly sized nails, screws and other fasteners comprising, in combination:

a vertically disposed plate having parallel upper and lower edges and have downwardly tapering side edges, the plate having a rear surface adapted to be received against a recipient member and a front surface adapted to have indicia and objects thereon;

a plurality of vertically disposed description zones along one side edge of the front surface and a plurality of vertically disposed locator zones along the other side edge of the front surface, each description zone being laterally offset from a related locator zone with each description zone having distinctive indicia and each of the locator zones having distinctive indicia with the description indicia and locator indicia being in related pairs laterally offset from each other;

a vertically disposed support region located between the description zones and the locator zones, the support region including a first strip of pile type fastener secured with respect to the central vertical extent of the plate and a removable pile type fastener strip removably coupled to the fixed pile type fastener strip whereby objects representative of each laterally disposed pair of indicator and locator zones may be received and supported thereat;

a tie-cord having free ends secured to the upper edge of the plate with a central extent adapted to be supported on a fastener in the recipient member; and a plurality of containers in a box-like configuration with a bottom wall located in a horizontal plane and upstanding side, front and rear vertical walls secured to each other and the bottom wall for the receipt of objects, the containers having a downwardly extending box-like projection positionable within the upper edge of an adjacent lower container and with indicia on the front wall exposed for view to indicate the nature of the contents within the container and correlated to a particular indicia at a locator zone.

2. An apparatus for organizing a work area and for locating properly sized nails, screws and other fasteners comprising;

a vertically disposed plate having parallel upper and lower edges and have side edges, the plate having a rear surface and a front surface adapted to have indicia and objects thereon;

a plurality of vertically disposed description zones along one side edge of the front surface and a plurality of vertically disposed locator zones along the other side edge of the front surface, each description zone being laterally offset from a related locator zone with each description zone having distinctive indicia with the description indicia and locator indicia being in related pairs laterally offset from each other;

a vertically disposed support region located between the description zones and the locator zones, the support region including a first strip of pile type fastener secured with respect to the central vertical extent of the plate and a removable pile type fastener strip removably coupled to the fixed pile type fastener strip whereby objects representative of each laterally disposed pair of indicator and locator zones may be received and supported;

a plurality of containers for objects correlated to the objects supported on the support region with indicia related thereto; and a plurality of containers in a box-like configuration with a bottom wall located in a horizontal plane and upstanding side, front and rear vertical walls secured to each other and the bottom wall for the receipt of objects, the containers having a downwardly extending box-like projection positionable within the upper edge of an adjacent lower container and with indicia on the front wall exposed for view to indicate the nature of the contents within the container and correlated to a particular indicia at a locator zone.

* * * * *